United States Patent [19]

Parssinen et al.

[11] 4,223,401

[45] Sep. 16, 1980

[54] BROADBAND FREE-FLOODING MAGNETOSTRICTIVE SCROLL TRANSDUCER

[75] Inventors: Edwin J. Parssinen, Mystic; Theodore J. Meyers, Waterford, both of Conn.

[73] Assignee: The United States of America as represented by the Secretary of the Navy, Washington, D.C.

[21] Appl. No.: 744,971

[22] Filed: Jul. 15, 1968

[51] Int. Cl.[3] ..... H04R 15/00

[52] U.S. Cl. ..... 367/168

[58] Field of Search ..... 340/11; 367/156, 168

[56] References Cited

U.S. PATENT DOCUMENTS

| | | | |
|---|---|---|---|
| 2,005,741 | 6/1935 | Hayes | 367/168 X |
| 2,521,136 | 9/1950 | Thuras | 367/168 X |
| 2,631,271 | 3/1953 | Thuras | 367/168 |
| 2,761,077 | 8/1956 | Harris | 367/168 X |
| 2,879,496 | 3/1959 | Camp | 367/168 |
| 2,962,679 | 11/1960 | Stratton | 336/83 |
| 3,393,401 | 7/1968 | Meyers | 367/168 |

*Primary Examiner*—Richard A. Farley

*Attorney, Agent, or Firm*—Richard S. Sciascia; Arthur A. McGill; Prithvi C. Lall

[57] ABSTRACT

A free-flooding, deep submergence cylindrical magnetostrictive transducer having a plurality of identical, coaxial, ring-shaped scrolls, surrounded by a toroidal coil, the scrolls being vibration isolated from each other and from the coil, and having ring resonance frequency sufficiently close to cavity resonance frequency for broadband operation, i.e. approximately one octave at the 6 db down points.

1 Claim, 2 Drawing Figures

BROADBAND FREE-FLOODING MAGNETOSTRICTIVE SCROLL TRANSDUCER

Figure 1:
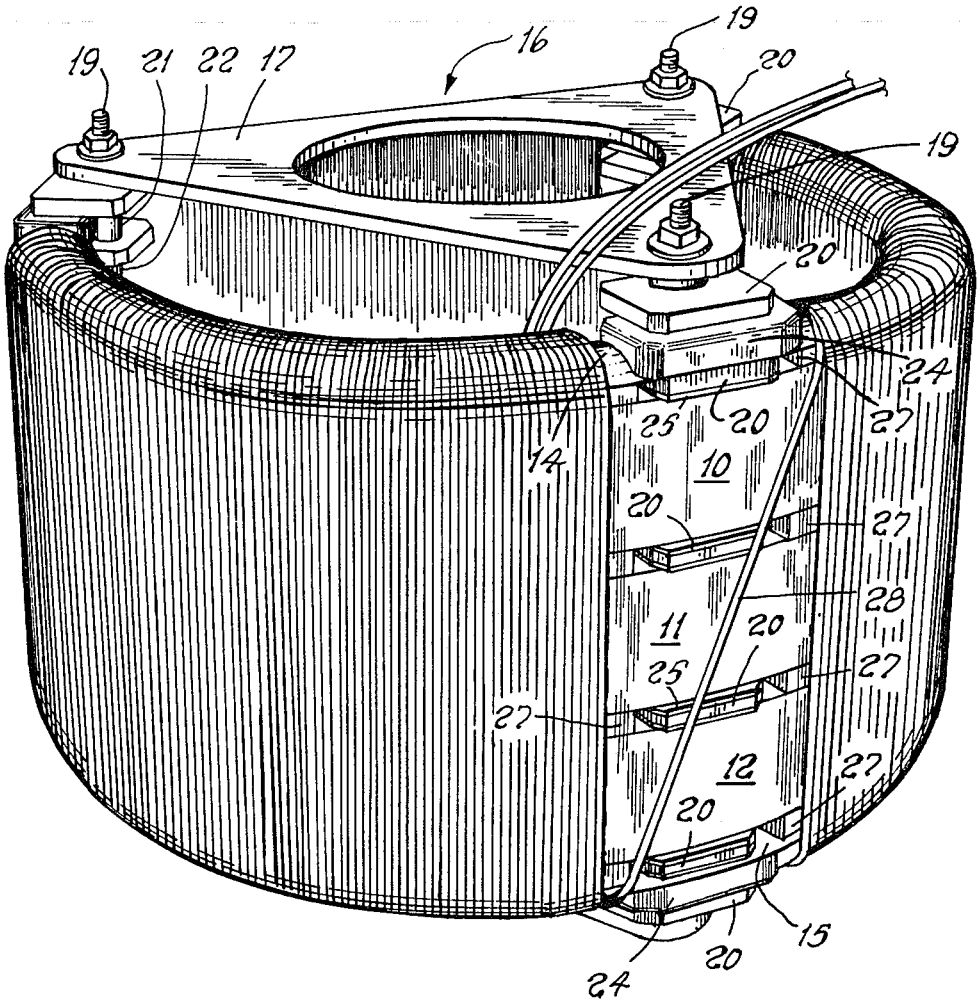

The invention described herein may be manufactured and used by or for the Government of the United States of America for governmental purposes without the payment of any royalties thereon or therefor.

BACKGROUND OF THE INVENTION

Scroll type magnetostrictive transducer rings have been used successfully at great depth underwater. A magnetostrictive scroll-type ring core has the usual advantages of magnetostrictive materials over ceramic materials in that it is easily fabricated and is reliable. The active material does not require water-proofing and is not damaged by overdriving. The ring is rugged, being very resistant to damage from explosive shock. Also it is insensitive to hydrostatic pressure up to maximum ocean depth. The ring is formed by tightly coiling a continuous strip of thin annealed magnetostrictive material and consolidating with a stiff tough resin such that the structure is void-free. An insulated waterproof wire conductor is toroidally coiled about the magnetostrictive ring as its core. The transducer is completely devoid of any pressure release material. In use the ring core and the toroidal electrical winding are exposed directly to seawater. The dimensions of the ring, viz. inside diameter, thickness, length, etc. and choice of material viz. nickel, nickel-cobalt, 2-V Permendur etc. depends upon desired transducer parameters. The ring resonance of the transducer is related to the mean circumference of the ring and also the density of the active material and the Young's modulus of the material. This device is an electroacoustic transducer for use underwater to convert electrical energy to acoustic energy for propagation. Properly polarized, the device is reciprocal, being capable also of converting acoustic energy to electrical energy.

SUMMARY OF THE INVENTION

The primary acoustic mode of a short, thin-walled, free-flooding, magnetostrictive scroll transducer is the ring resonance or radial mode and the mean circumference of the ring approximates the wavelength of that resonance. The radial motion of the ring excites the water column within the ring. This effect is termed cavity resonance. The two resonant frequencies do not constitute one band in the transducers described because the cavity resonance is at a much higher frequency than the ring resonance and there is no coupling between the ring resonance and the cavity resonance. The invention combines a plurality of such transducers in coaxial relationship, essentially not coupled vibrationally to shift the cavity resonance of the combination to a lower frequency than ring resonance but still sufficiently close so that there is coupling between the two resonances, i.e. the frequency response between the two resonances does not fall off appreciably. For any scroll of preselected design, the cavity resonance of an assembly of a plurality of those scrolls decreases with increase in number of the scrolls and the optimum combination with broadened bandwidth is obvious.

An object of this invention is to provide a free-flooding magnetostrictive scroll type transducer having broader band frequency response in addition to its other advantages.

Other objects and advantages will appear from the following description of an example of the invention, and the novel features will be particularly pointed out in the appended claims.

Figure 2:
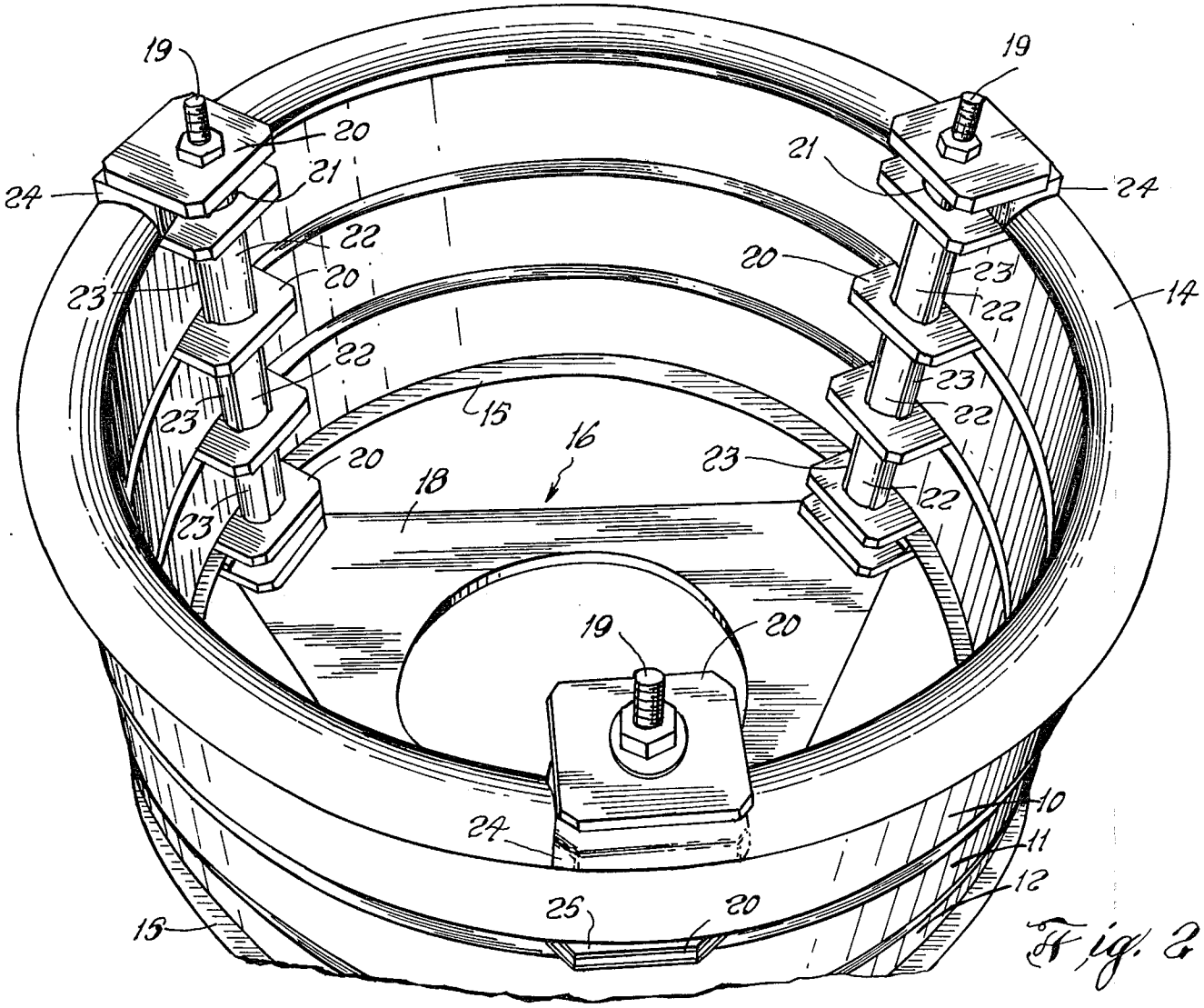

In the accompanying drawings:

FIG. 1 is a view in perspective of a transducer assembly according to this invention, and FIG. 2 is a perspective view of part of the transducer shown in FIG. 1 minus the toroidal conductor, end plate, and salt spacers between rings.

The illustrated embodiment of the invention includes three essentially identical coaxial magnetostrictive rings 10, 11 and 12. The rings are short, thin-walled, tightly-coiled scrolls of annealed magnetostrictive strip material consolidated with a stiff resin and essentially free of voids. The strip material is on the order of 0.01 inch thick. The inside radius of the ring is substantially greater than its height e.g. 3:1, and is very much greater than its thickness e.g. 6:1. Permendur or nickel 204 are examples of suitable commercial magnetostrictive alloys. The consolidation resin selected has some influence on performance but not on operability. Scotchcast epoxy number 3 is an example of a stiff epoxy resin that has provided satisfactory results. The rings are axially spaced a distance equal to a minor fraction of the axial length of one ring. Two rigid nonmagnetic rings 14 and 15 are retained adjacent to the opposite ends of the outer rings 10 and 12 and coaxial with the magnetostrictive rings. The nonmagnetic rings have smaller inside diameter and larger outside diameter than the magnetostrictive rings, and are approximately semicircular in radial cross section to present an outwardly directed curved surface and a flat surface directed toward the magnetostrictive rings. A framework 16 holds the rings together. The framework includes a pair of end plates 17 and 18 that have aligned holes. Three rods 19 threaded at both ends each stack six essentially identical lug elements 20, separated by five spacer elements, including two end spacer elements 21 and three intermediate spacer elements 22, and are longer than the axial dimension of each magnetostrictive ring. Compressible elastic vibration isolators 23 between the intermediate stacked spacers 22 and the inside surfaces of the magnetostrictive rings are of a thickness for a snug fit to retain the magnetostrictive rings in coaxial relationship. A cradling element 24 is disposed between each of the outermost lug elements 20 and the curved outer surfaces of nonmagnetic rings 14 and 15. A U-shaped vibration isolation sleeve 25 is assembled on every lug 20 other than the end-most lugs and include compressible elastic material. The intermediate lugs 20 and the vibration isolation sleeves do not constrain the magnetostrictive rings significantly against radial vibration. Spacers between the rings and between lugs are occupied by salt slabs 27 in FIG. 1 to prevent canting the rings relative to one another when a conductor is tightly coiled on the assembly. The salt is dissolved after its purpose is served.

An insulated conductor 28 is wound toroidally on the ring assembly skipping across the arcuate portions engaged by the lugs. Because the nonmagnetic rings are wider than the magnetostrictive rings the conductor does not mechanically load the magnetostrictive rings. The ends of the coil are connected to transmitter-receiver circuitry, not shown. The transducer is devoid of any pressure release material.

When scrolls are mounted, care must be exercised to ensure that the mounting hardware does not form a shorted electrical turn around the core material in a manner similar to a shorted secondary of a toroidal transformer. If there is a shorted loop, considerable amounts of energy may be dissipated in the shorted loop.

In use, the assembly is immersed directly in seawater. Experiments proved that seawater does not act as a shorted loop in a scroll transducer. No difference was found in measured transducer parameters, in tests in fresh water and seawater. Also, tests established that the use of a neoprene covering on the scrolls to resist corrosion by seawater reduced efficiency of the transducer to a degree that the neoprene covering is deemed unacceptable. It was found that the tighter and more complete the encirclement of the active material by the toroidally wound conductor the higher the coupling coefficient. There is more leakage flux when more of the core material is left uncovered by the winding.

The primary mode of operation of a short, thin-walled, free-flooding, magnetostrictive scroll transducer is the radial mode. If the thickness is not excessive and it is not too long the transucer has well-defined ring resonance. The radial motion of the ring stimulates the water column enclosed within the ring which action is termed cavity resonance. In a short free-flooding single scroll the cavity resonance is at a higher frequency than the ring resonance and the resonances are spread too far to constitute a single band. An assembly of three rings as described properly dimensioned, brings the ring and cavity resonances sufficiently close together to form a single broadened band.

It will be understood that various changes in the details materials, and arrangements of parts (and steps), which have been herein described and illustrated in order to explain the nature of the invention, may be made by those skilled in the art within the principle and scope of the invention as expressed in the appended claims.

We claim:

1. A broad bandwidth free-flooding magnetostrictive scroll transducer comprising:

a framework including a plurality of parallel rods rigidly joined at opposite ends and carrying radially outwardly directed supporting lugs, and means for locating the lugs along the rods, a plurality of essentially identical ring-shaped magnetostrictive scrolls, each consolidated with stiff resin and essentially void-free and supported coaxially by the lugs of the framework and around the exterior of the framework, separate from one another a distance which is a minor fraction of scroll length, compressible elastic vibration isolators between the lugs and the respective scrolls permitting the scrolls to vibrate radially relative to the framework, a pair of nonmagnetic rings having smaller inside diameter and larger outside diameter than the scrolls clamped by lugs of the framework coaxial with the scrolls and at opposite ends of the plurality of scrolls and spaced slightly from the scrolls, and an insulated conductor toroidally coiled tightly around the coaxial pair of nonmagnetic rings.

* * * * *